US011350775B2

(12) United States Patent
Hunsinger

(10) Patent No.: US 11,350,775 B2
(45) Date of Patent: Jun. 7, 2022

(54) PILLOW SYSTEM AND APPARATUS HAVING DIFFERENT TACTILE TEXTURES

(71) Applicant: Shining Star Stitchery LLC, Houston, TX (US)

(72) Inventor: Alisa Brickman Hunsinger, Houston, TX (US)

(73) Assignee: SHINING STAR STITCHERY LLC, Houston, TX (US)

( * ) Notice: Subject to any disclaimer, the term of this patent is extended or adjusted under 35 U.S.C. 154(b) by 48 days.

(21) Appl. No.: 16/866,334

(22) Filed: May 4, 2020

(65) Prior Publication Data

US 2021/0337989 A1 Nov. 4, 2021

(51) Int. Cl.
*A47G 9/10* (2006.01)

(52) U.S. Cl.
CPC ..... *A47G 9/10* (2013.01); *A47G 2200/22* (2013.01)

(58) Field of Classification Search
CPC ..... A47G 9/10; A47G 2200/22
See application file for complete search history.

(56) References Cited

U.S. PATENT DOCUMENTS 3,443,267 A 5/1969 Schuckman
4,309,784 A * 1/1982 Cohen ..... A47G 9/0253 5/639
4,660,239 A 4/1987 Thomas
4,756,035 A * 7/1988 Beier ..... A47G 9/1081 5/640
4,916,765 A * 4/1990 Castronovo, Jr. .... A47G 9/1081 297/284.1
4,959,880 A * 10/1990 Tesch ..... A47G 9/10 5/636
4,989,285 A * 2/1991 Troncone ..... A47D 15/00 5/482
5,123,132 A 6/1992 Dixon
(Continued)

FOREIGN PATENT DOCUMENTS

CN 2335495 Y 9/1999
CN 208909583 U 5/2019
(Continued)

OTHER PUBLICATIONS

FatheringAutism, DIY Weighted Lap Pad Sensory Fidget, Dec. 15, 2016, Youtube, https://www.youtube.com/watch?v= 0waCiX6YT4M (Year: 2016).*

*Primary Examiner* — Eric J Kurilla
(74) *Attorney, Agent, or Firm* — Kunzler Bean & Adamson

(57) ABSTRACT

Systems and apparatuses having different tactile textures are disclosed. One system includes a pillow. The pillow includes a bottom surface having a first material, and a top surface coupled to the bottom surface. The top surface includes a second material and a third material. The first, second, and third materials have different tactile textures from one another, and the first, second, and third materials are all on an exterior surface of the pillow. The pillow includes a zipper coupling a first portion of the bottom surface to a second portion of the top surface. The pillow includes a pocket formed between the top and bottom surfaces. The pocket is accessible using the zipper, and configured to hold weighted bags. The system includes the weighted bags. Each weighted bag includes weighted pellets, and is configured to be disposed in the pocket to adjust the weight within the pocket.

16 Claims, 7 Drawing Sheets

(56) References Cited

U.S. PATENT DOCUMENTS 5,168,590 A * 12/1992 O'Sullivan ..... A47G 9/0253 5/421
5,664,269 A * 9/1997 Broder ..... A47G 9/0207 5/482
5,706,535 A * 1/1998 Takashima ..... A47G 9/007 5/485
5,809,594 A * 9/1998 Isogai ..... A47G 9/10 5/644
5,819,347 A * 10/1998 Masuda ..... A47G 9/007 5/641
5,953,777 A * 9/1999 Buck ..... A47G 9/0253 5/636
6,058,535 A * 5/2000 Firkins, Jr. ..... A47C 7/021 5/653
6,151,733 A * 11/2000 Takashima ..... A47G 9/10 5/636
6,243,896 B1 * 6/2001 Osuna ..... A47G 9/0261 5/502
6,363,557 B2 * 4/2002 Chou ..... A47G 9/0253 5/636
6,383,130 B1 5/2002 Wade
7,222,379 B2 * 5/2007 DiGirolamo ..... A47G 9/10 5/636
7,870,623 B2 * 1/2011 Judd ..... A61H 7/001 5/502
8,672,724 B2 3/2014 Beuerle
9,265,357 B2 2/2016 Fang
D795,611 S * 8/2017 Dickholtz, Jr. ..... D6/601
10,098,486 B2 10/2018 Wagner
2002/0095725 A1 * 7/2002 Dix ..... A47G 9/0223 5/482
2004/0199998 A1 10/2004 Shinner
2005/0210590 A1 * 9/2005 DiGirolamo ..... A47G 9/10 5/636
2005/0273930 A1 12/2005 Phillipps
2006/0016005 A1 * 1/2006 Roda ..... A41B 13/06 5/482
2006/0090248 A1 5/2006 McKenzie
2009/0100568 A1 4/2009 Judd
2009/0149698 A1 * 6/2009 Tastard ..... A61M 21/00 600/27
2010/0132231 A1 * 6/2010 Kozel ..... A47C 31/123 40/1
2011/0047698 A1 3/2011 Parker
2013/0191998 A1 8/2013 Wootten, Jr.
2015/0135442 A1 * 5/2015 Deane ..... A47G 9/10 5/636
2015/0265077 A1 9/2015 Miller et al.
2015/0335853 A1 11/2015 Orewiler et al.
2016/0213176 A1 * 7/2016 Clemente, II ..... A47G 9/1081
2017/0014595 A1 1/2017 Heath
2017/0181555 A1 6/2017 Al-Bahsan
2017/0325606 A1 * 11/2017 Robertson ..... A47G 9/1045
2018/0103783 A1 4/2018 Danaher
2018/0168372 A1 6/2018 Pool
2018/0213954 A1 8/2018 Grinstead
2019/0060604 A1 2/2019 Smith
2019/0239665 A1 * 8/2019 Ponder ..... A47G 9/1081
2019/0274454 A1 9/2019 Bidhendi
2019/0320827 A1 10/2019 Mess
2020/0100606 A1 * 4/2020 Ganji ..... A61F 5/56
2020/0128971 A1 * 4/2020 Levy ..... A47G 9/10
2020/0288892 A1 * 9/2020 Esser ..... A47G 9/1045

FOREIGN PATENT DOCUMENTS

GB 2342289 A 12/2000
JP 10158951 A 6/1998
JP 2008188157 A 8/2008
KR 101909887 B1 10/2018
KR 101977730 B1 5/2019
WO 1995013045 A1 5/1995
WO 2011107863 A1 9/2011
WO 2014166556 A1 10/2014
WO 2014166557 A1 10/2014
WO 2019020219 A1 1/2019

* cited by examiner

PILLOW SYSTEM AND APPARATUS HAVING DIFFERENT TACTILE TEXTURES

FIELD

The subject matter disclosed herein relates to pillows and more particularly relates to pillow systems and apparatuses having different tactile textures.

BACKGROUND

Pillows are traditionally used to support a person's body at rest for comfort, therapy, or decoration. Some types of pillows include throw pillows, body pillows, and decorative pillows. Pillows to aid sleeping may be a form of bedding that supports the head and neck. Other types of pillows may be designed to support a body when lying down or sitting.

BRIEF SUMMARY

Systems and apparatuses having different tactile textures are disclosed. In one embodiment, a system includes a pillow. The pillow, in a further embodiment, includes a bottom surface having a first material. In various embodiments, the pillow includes a top surface coupled to the bottom surface. The top surface includes a second material and a third material. The first material, the second material, and the third material have different tactile textures from one another, and the first material, the second material, and the third material are all on an exterior surface of the pillow. In certain embodiments, the pillow includes a zipper coupling a first portion of the bottom surface to a second portion of the top surface. In some embodiments, the pillow includes a pocket formed between the top surface and the bottom surface. The pocket is accessible using the zipper, and the pocket is configured to hold multiple weighted bags. In various embodiments, the system includes the multiple weighted bags. Each weighted bag of the multiple weighted bags includes weighted pellets, and each weighted bag of the multiple weighted bags is configured to be disposed in the pocket to adjust the weight within the pocket.

An apparatus having different tactile textures, in one embodiment, includes a pillow. The pillow, in a further embodiment, includes a bottom surface having a first material. In various embodiments, the pillow includes a top surface coupled to the bottom surface. The top surface includes a second material and a third material. The first material, the second material, and the third material have different tactile textures from one another, and the first material, the second material, and the third material are all on an exterior surface of the pillow. In certain embodiments, the pillow includes a zipper coupling a first portion of the bottom surface to a second portion of the top surface. In some embodiments, the pillow includes a pocket formed between the top surface and the bottom surface. The pocket is accessible using the zipper, and the pocket is configured to hold multiple weighted bags.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1:
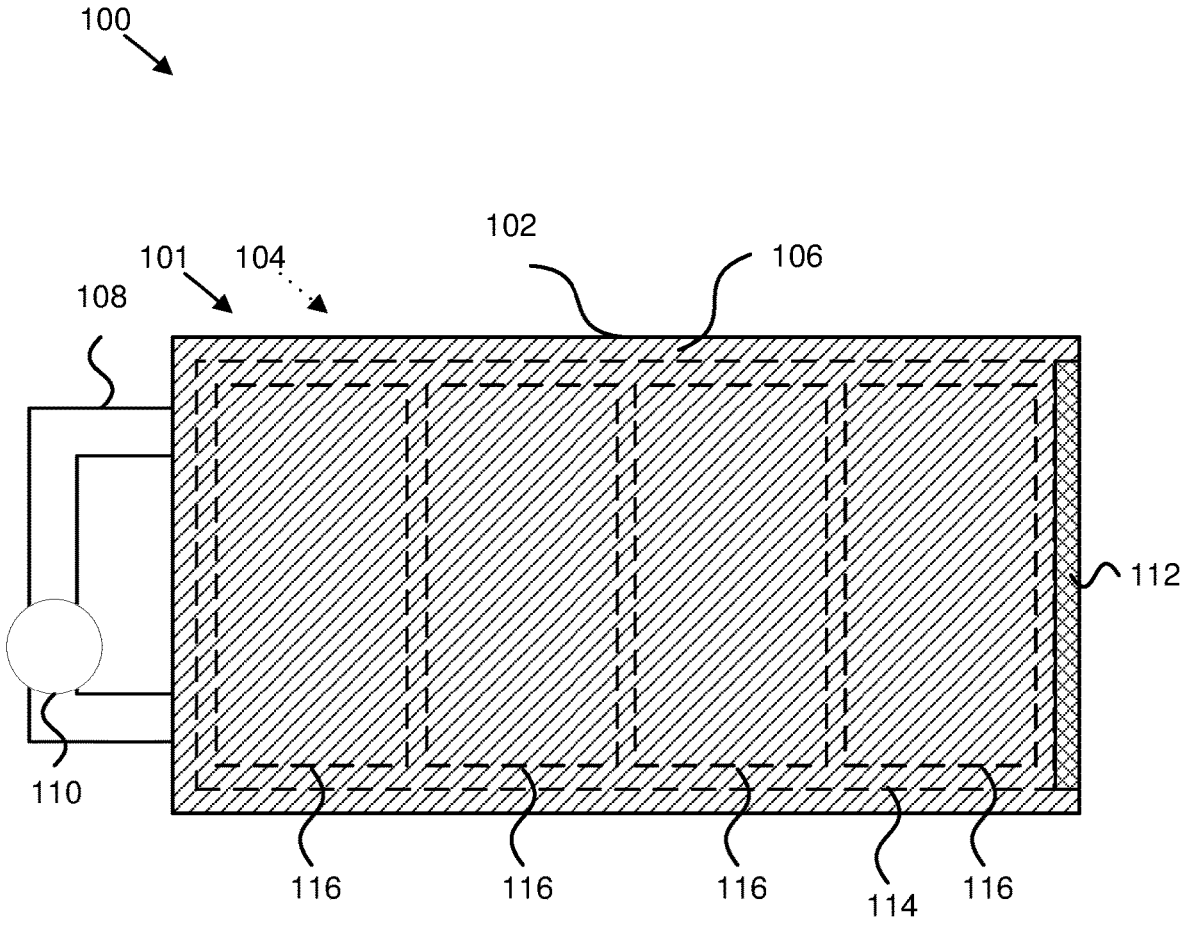
FIG. 1 is a top view of one embodiment of a system having different tactile textures.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The present invention may be a system and/or an apparatus. Aspects of the present invention may be described herein with reference to flowchart illustrations and/or block diagrams of methods and/or apparatus (systems).

The described features, structures, or characteristics of the embodiments may be combined in any suitable manner. In the following description, numerous specific details are provided, such as examples of materials, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

The schematic flowchart diagrams and/or schematic block diagrams in the Figures illustrate the architecture, functionality, and operation of possible implementations. It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Although various arrow types and line types may be employed in the flowchart and/or block diagrams, they are understood not to limit the scope of the corresponding embodiments. Indeed, some arrows or other connectors may be used to indicate only an exemplary logical flow of the depicted embodiment.

The description of elements in each figure may refer to elements of proceeding figures. Like numbers refer to like elements in all figures, including alternate embodiments of like elements.

FIG. 1 is a top view of one embodiment of a system 100 having different tactile textures. The system 100 includes a pillow 101. The pillow 101 includes multiple tactile textures and/or weighted bags to facilitate sensory stimulation. Such sensor stimulation may facilitate calming an individual using the pillow 101.

The pillow 101 has a bottom surface 102 and a top surface 104. Moreover, the bottom surface 102 has a first material 106 on an exterior surface of the pillow 101. The first material 106 has a tactile texture different from other materials on the exterior surface of the pillow 101. For example, the first material 106 may be a fabric, such as fleece, burlap, corduroy, felt, silk, satin, lace, wool, cotton, sequins, pleated fabric, shined fabric, ribbon weave fabric, quilted fabric, crepe, hammered satin, net fabric, fur, chinchilla, embroidered, waffle cloth, double knit fabric, leno weave fabric, tweed, sweater knit, terrycloth, crinkle finished cotton, jacquard woven fabric, laminated fabric, leather, ribbon knit, slubbed silk, fabric with flocked designs, boucle fabric, huckaback fabric, metallic fabric, damask, velvet, linen, polyester, nylon, spandex, cashmere, rayon, bamboo, and so forth.

The pillow 101 includes a handle 108 that facilitates holding the pillow 101. The handle 108 may be formed from any suitable material, such as a fabric, wood, plastic, or another material. A bead 110 (e.g., tactile bead) is disposed on the handle 108. The bead 110 may have a hole therein so that the bead 110 is disposed around the handle 108 and moveable along the handle 108 and/or rotatable at one or more positions on the handle 108. The bead 110 may be formed from any suitable material, such as a fabric, wood, plastic, or another material. While only one bead 110 is illustrated, in other embodiments, one or more beads may be disposed on the handle 108. Moreover, the bead 110 may be any suitable size and/or shape (e.g., spherical, rectangular, triangular, egg, etc.). In various embodiments, the bead 110 may be replaced with any suitable sensory object.

The pillow 101 includes a zipper 112 disposed along one end of the pillow 101. The zipper 112 may be opened (e.g., un-zipped) and closed (e.g., zipped) to insert and/or remove items disposed inside a pocket 114 formed within the pillow 101. The zipper 112 may extend along any suitable distance on any side of the pillow 101 to facilitate access to the pocket 114. The zipper 112 couples a first portion of the bottom surface 102 to a second portion of the top surface 104. The pocket 114 is formed between the top surface 104 and the bottom surface 102 and is accessible using the zipper 112. The pocket 114 is configured to hold one or more objects (e.g., weighted bags).

The system 100 includes multiple weighted bags 116 that may be disposed within the pocket 114 inside the pillow 101. The weighted bags 116 may be used to make the pillow 101 a weighted pillow. As may be appreciated, a weighted pillow may have a calming affect on a person that positions the weighted pillow on their lap. In the system 100 illustrated in FIG. 1, four weighted bags 116 are illustrated. However, in other embodiments, any suitable number of weighted bags 116 may be disposed inside the pillow 101. For example, there may be 1, 2, 3, 4, 5, 6, 7, 8, 9, 10, or more weighted bags disposed inside the pillow 101. In certain embodiments, each weighted bag 116 has approximately the same weight. In various embodiments, each weighted bag 116 has a substantially different weight. Weighted bags 116 may be added to and/or removed from the pillow 101 to adjust the weight of the pillow 101 to a desired weight.

Figure 2:
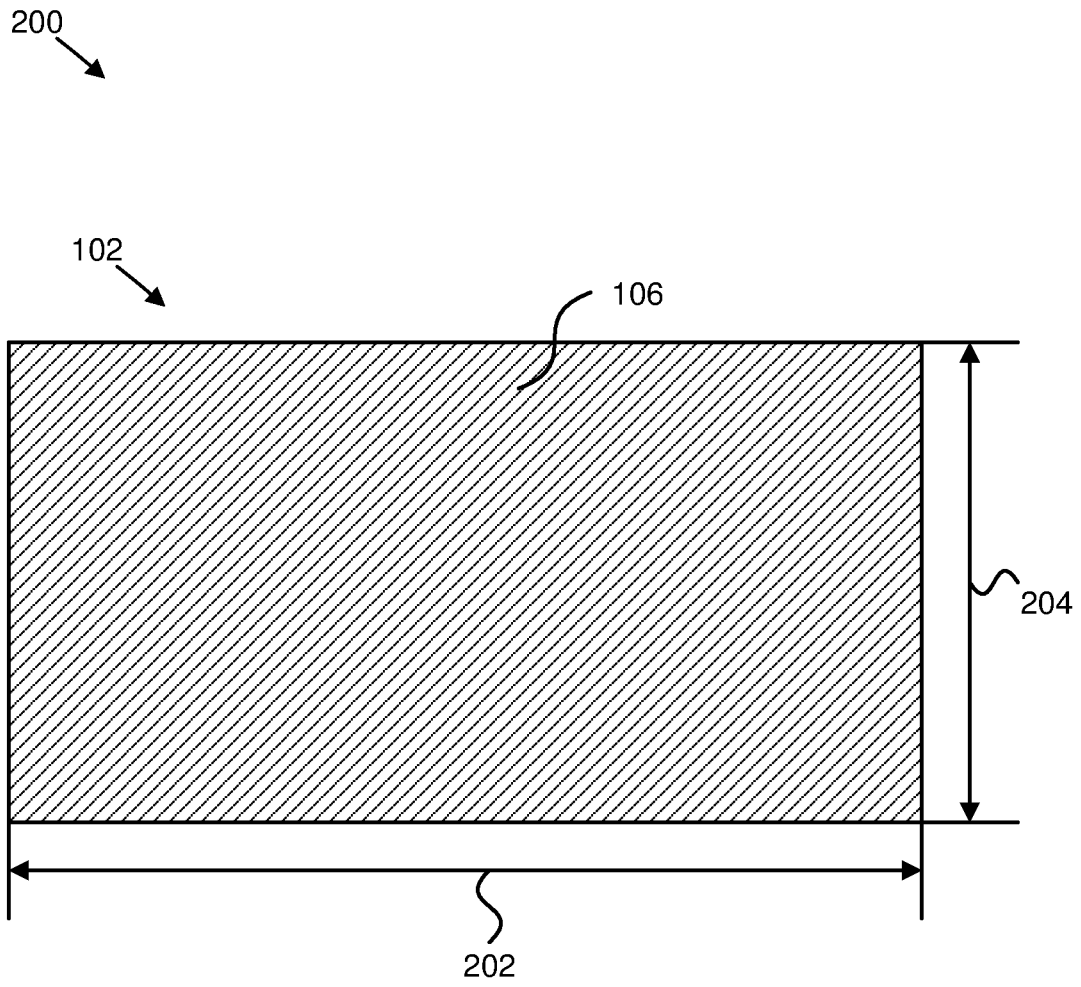
FIG. 2 is a top view of one embodiment of a bottom surface of a pillow.

FIG. 2 is a top view 200 of one embodiment of the bottom surface 102 of the pillow 101. The bottom surface 102 has the first material 106 on an exterior surface of the pillow 101. The first material 106 has a tactile texture different from other materials on the exterior surface of the pillow 101. For example, as described previously, the first material 106 may be a fabric, such as fleece, burlap, corduroy, felt, silk, satin, lace, wool, cotton, sequins, pleated fabric, shined fabric, ribbon weave fabric, quilted fabric, crepe, hammered satin, net fabric, fur, chinchilla, embroidered, waffle cloth, double knit fabric, leno weave fabric, tweed, sweater knit, terrycloth, crinkle finished cotton, jacquard woven fabric, laminated fabric, leather, ribbon knit, slubbed silk, fabric with flocked designs, boucle fabric, huckaback fabric, metallic fabric, damask, velvet, linen, polyester, nylon, spandex, cashmere, rayon, bamboo, and so forth.

The first material 106 of the bottom surface 102 has a length 202 and a width 204. As may be appreciated, the length 202 and the width 204 may be any suitable dimensions. In one embodiment, the length 202 may be within a range of 8 to 44 inches, 10 to 20 inches, and/or 15 to 30 inches. For example, the length 202 may be approximately 22 inches. In certain embodiments, the width 204 may be within a range of 4 to 20 inches, 5 to 10 inches, and/or 7 to 18 inches. For example, the width 204 may be approximately 7 inches.

Figure 3:
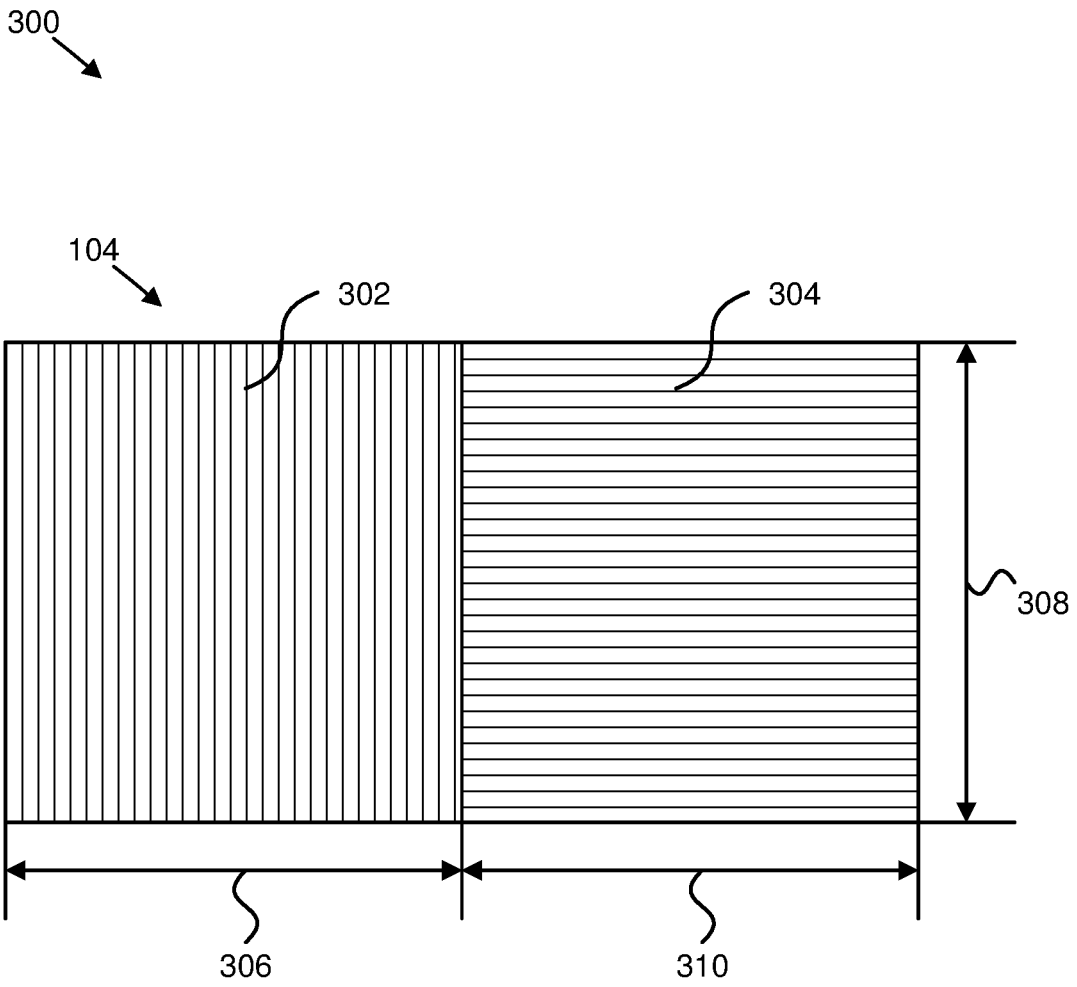
FIG. 3 is top view of one embodiment of a top surface of a pillow.

FIG. 3 is top view 300 of one embodiment of the top surface 104 of the pillow 101. The top surface 104 includes a second material 302 and a third material 304 on an exterior surface of the pillow 101. The second and third materials 302 and 304 have a tactile texture different from other materials on the exterior surface of the pillow 101. For example, the second and third materials 302 and 304 may be fabrics, such as fleece, burlap, corduroy, felt, silk, satin, lace, wool, cotton, sequins, pleated fabric, shirred fabric, ribbon weave fabric, quilted fabric, crepe, hammered satin, net fabric, fur, chinchilla, embroidered, waffle cloth, double knit fabric, leno weave fabric, tweed, sweater knit, terrycloth, crinkle finished cotton, jacquard woven fabric, laminated fabric, leather, ribbon knit, slubbed silk, fabric with flocked designs, boucle fabric, huckaback fabric, metallic fabric, damask, velvet, linen, polyester, nylon, spandex, cashmere, rayon, bamboo, and so forth. In one embodiment, the first material 106 is cotton, the second material 302 is sequins, and the third material 304 is wool. In another embodiment, the first material 106 is cotton, the second material 302 is reversable sequins, and the third material 304 is minky.

The second material 302 of the top surface 104 has a length 306 and a width 308. As may be appreciated, the length 306 and the width 308 may be any suitable dimensions. In one embodiment, the length 306 may be within a range of 4 to 22 inches, 5 to 10 inches, and/or 8 to 15 inches. For example, the length 306 may be approximately 11 inches. In certain embodiments, the width 308 may be within a range of 4 to 20 inches, 5 to 10 inches, and/or 7 to 18 inches. For example, the width 308 may be approximately 7 inches.

The third material 304 of the top surface 104 has a length 310 and the width 308. As may be appreciated, the length 310 and the width 308 may be any suitable dimensions. In one embodiment, the length 310 may be within a range of 4 to 22 inches, 5 to 10 inches, and/or 8 to 15 inches. For example, the length 310 may be approximately 11 inches. In certain embodiments, the width 308 may be within a range of 4 to 20 inches, 5 to 10 inches, and/or 7 to 18 inches. For example, the width 308 may be approximately 7 inches. As may be appreciated, in some embodiments, a first external surface area of the first material 106 (e.g., the length 202 times the width 204) may be substantially equal to a sum of a second external surface area of the second material 302 (e.g., the length 306 times the width 308) and a third external surface area of the third material 304 (e.g., the length 310 times the width 308).

Figure 4:
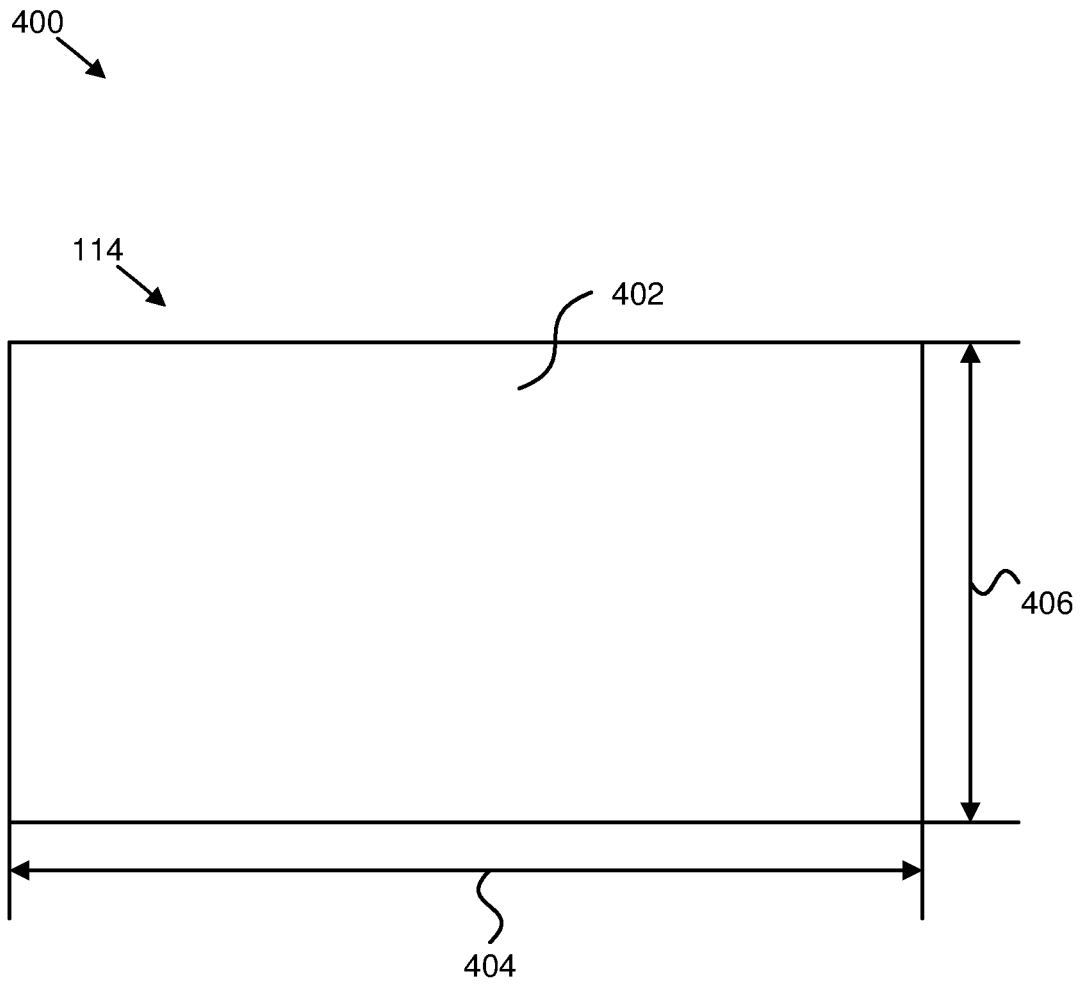
FIG. 4 is a diagram that illustrates one embodiment of a pocket of a pillow.

FIG. 4 is a diagram 400 that illustrates one embodiment of the pocket 114 of the pillow 101. The pocket 144 is formed from a material 402. The material 402 may be a fabric, such as fleece, burlap, corduroy, felt, silk, satin, lace, wool, cotton, sequins, pleated fabric, shirred fabric, ribbon weave fabric, quilted fabric, crepe, hammered satin, net fabric, fur, chinchilla, embroidered, waffle cloth, double knit fabric, leno weave fabric, tweed, sweater knit, terrycloth, crinkle finished cotton, jacquard woven fabric, laminated fabric, leather, ribbon knit, slubbed silk, fabric with flocked designs, boucle fabric, huckaback fabric, metallic fabric, damask, velvet, linen, polyester, nylon, spandex, cashmere, rayon, bamboo, and so forth.

The material 402 of the pocket 114 has a length 404 and a width 406. As may be appreciated, the length 404 and the width 406 may be any suitable dimensions. In one embodiment, the length 404 may be within a range of 8 to 44 inches, 10 to 20 inches, and/or 15 to 30 inches. For example, the length 404 may be approximately 22 inches. In certain embodiments, the width 406 may be within a range of 4 to 20 inches, 5 to 10 inches, and/or 7 to 18 inches. For example, the width 204 may be approximately 7 inches. In some embodiments, the surface area of the pocket 114 may be approximately the same as the surface area of the bottom surface 102. In other embodiments, the surface area of the pocket 114 may be substantially smaller than the surface area of the bottom surface 102. In certain embodiments, the material 402 of the pocket 114 may be the back side of the first material 106, the second material 302, and/or the third material 304. In various embodiments, the material 402 of the pocket 114 may be interfacing material that is attached to the first material 106, the second material 302, and/or the third material 304.

Figure 5:
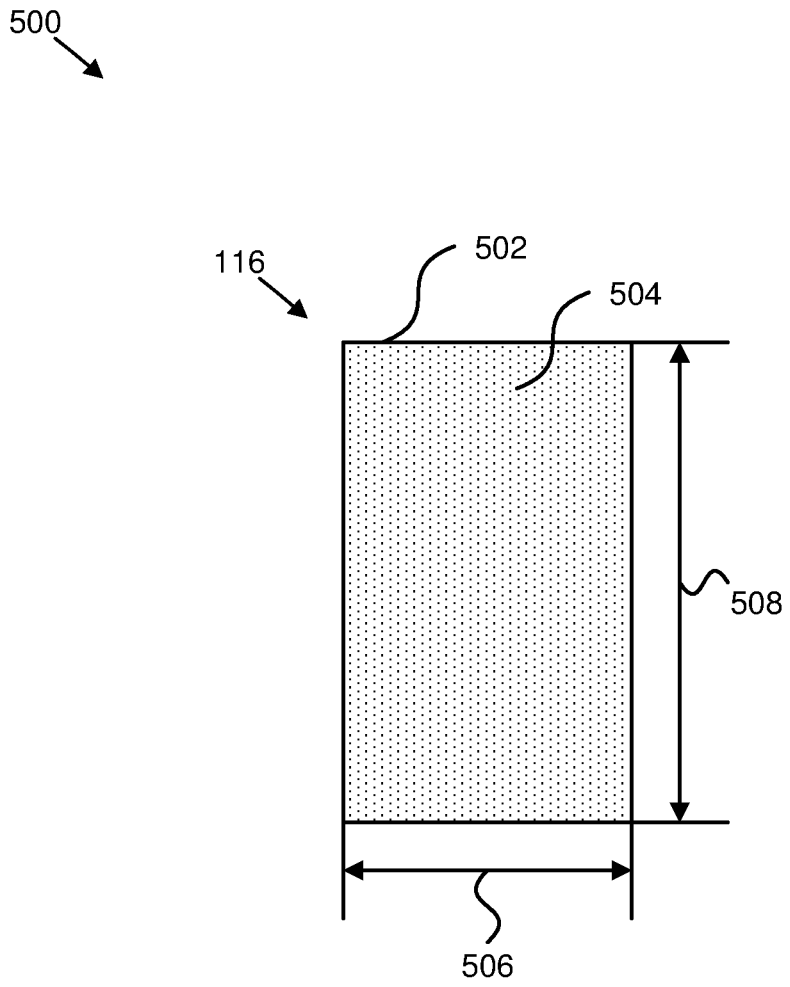
FIG. 5 is a diagram that illustrates one embodiment of a weighted bag.

FIG. 5 is a diagram 500 that illustrates one embodiment of the weighted bag 116. As may be appreciated, weighted bags 116 are configured to be disposed within the pocket 114 to adjust a weight within the pocket 114. The weighted bag 116 is formed from a material 502 that is filled with weighted pellets 504. The material 502 may be a fabric, such as fleece, burlap, corduroy, felt, silk, satin, lace, wool, cotton, sequins, pleated fabric, shirred fabric, ribbon weave fabric, quilted fabric, crepe, hammered satin, net fabric, fur, chinchilla, embroidered, waffle cloth, double knit fabric, leno weave fabric, tweed, sweater knit, terrycloth, crinkle finished cotton, jacquard woven fabric, laminated fabric, leather, ribbon knit, slubbed silk, fabric with flocked designs, boucle fabric, huckaback fabric, metallic fabric, damask, velvet, linen, polyester, nylon, spandex, cashmere, rayon, bamboo, and so forth. In various embodiments, the material 502 and the material 402 may be selected so that there is a high friction between the materials to inhibit movement of the weighted bag 116 within the pocket 114. For example, the material 502 may be cotton and the material 402 may be an interfacing material or the backside of the first material 106, the second material 302, and/or the third material 304. The weighted pellets 504 may be any suitable weighted material, such as plastic, glass, sand, dirt, corn, rice, and so forth. The weighted bag 116 may have a specific weight, such as 0.5 pounds, 1.0 pounds, 2.0 pounds, 4.0 pounds, and so forth.

The material 502 of the weighted bag 116 has a length 506 and a width 508. As may be appreciated, the length 506 and the width 508 may be any suitable dimensions. In one embodiment, the length 506 may be within a range of 2 to 6 inches, 4 to 15 inches, and/or 13 to 22 inches. For example, the length 506 may be approximately 3 inches. In certain embodiments, the width 508 may be within a range of 4 to 20 inches, 5 to 10 inches, and/or 7 to 18 inches. For example, the width 508 may be approximately 7 inches. The length 506 and/or the width 508 of the weighted bag 116 may be selected to inhibit movement of the weighted bag 116 when disposed inside the pocket 114.

Figure 6:
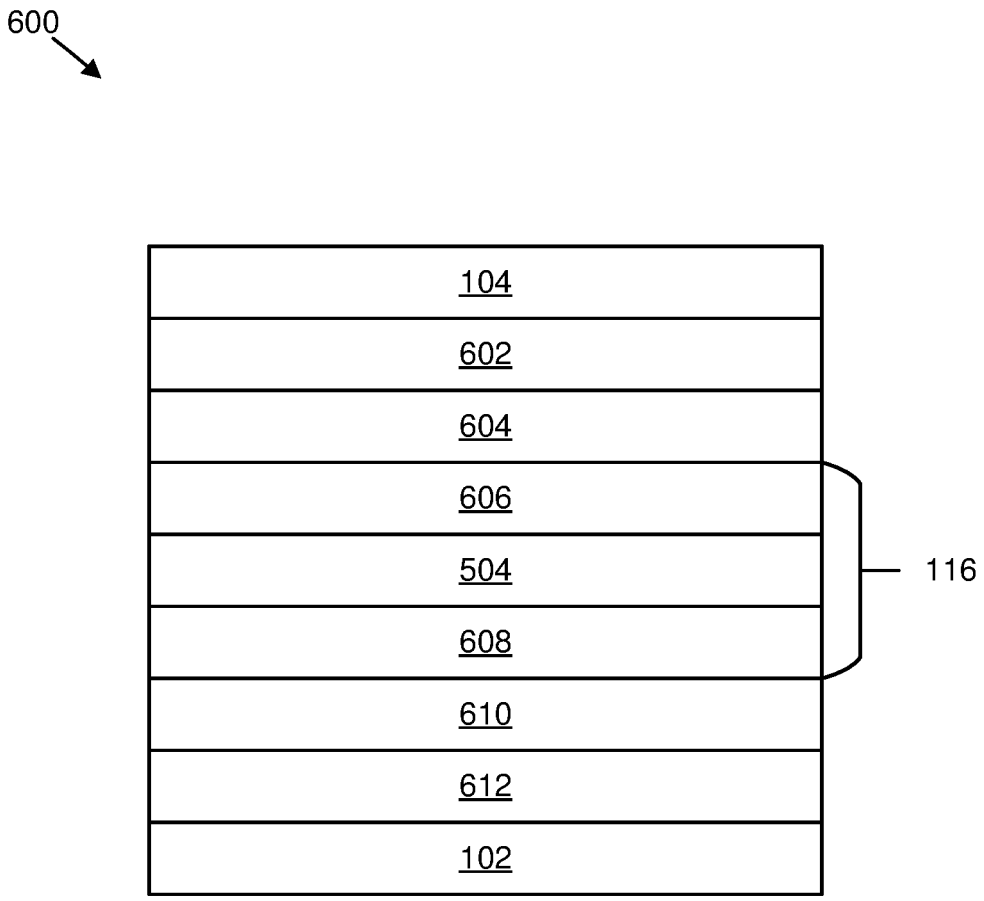
FIG. 6 is a schematic diagram illustrating one embodiment of layers of a pillow.

FIG. 6 is a schematic diagram illustrating one embodiment of layers 600 of the pillow 101. The layers 600 include the top surface 104, a first interfacing layer 602, a top pocket layer 604, a top weighted bag layer 606, the weighted pellets 504, a bottom weighted bag layer 608, a bottom pocket layer 610, a second interfacing layer 612, and the bottom surface 102. The first interfacing layer 602 and/or the second interfacing layer 612 may be referred to as interfacing. The interfacing may include a fourth material coupled to the first material 106, the second material 302, and/or the third material 304. The fourth material provides reinforcement to the first material 106, the second material 302, and/or the third material 304. For example, the fourth material may inhibit tears, rips, and/or wearing down of the first material 106, the second material 302, and/or the third material 304. In some embodiments, the fourth material is coupled to the first material 106, the second material 302, and/or the third material 304 using an adhesive (e.g., a heat activated adhesive, a glue, etc.), while, in other embodiments, the fourth material may be sewed or otherwise physically attached to the first material 106, the second material 302, and/or the third material 304 without an adhesive. In various embodiments, the fourth material may be any suitable material such as a poly woven textile that has an adhesive layer built into one side. The fourth material combined with the first material 106, the second material 302, and/or the third material 304 may be considered reinforced fabric. The top pocket layer 604 and the bottom pocket layer 610 are formed from the material 402. Moreover, the top weighted bag layer 606 and the bottom weighted bag layer 608 are formed from the material 502.

Figure 7:
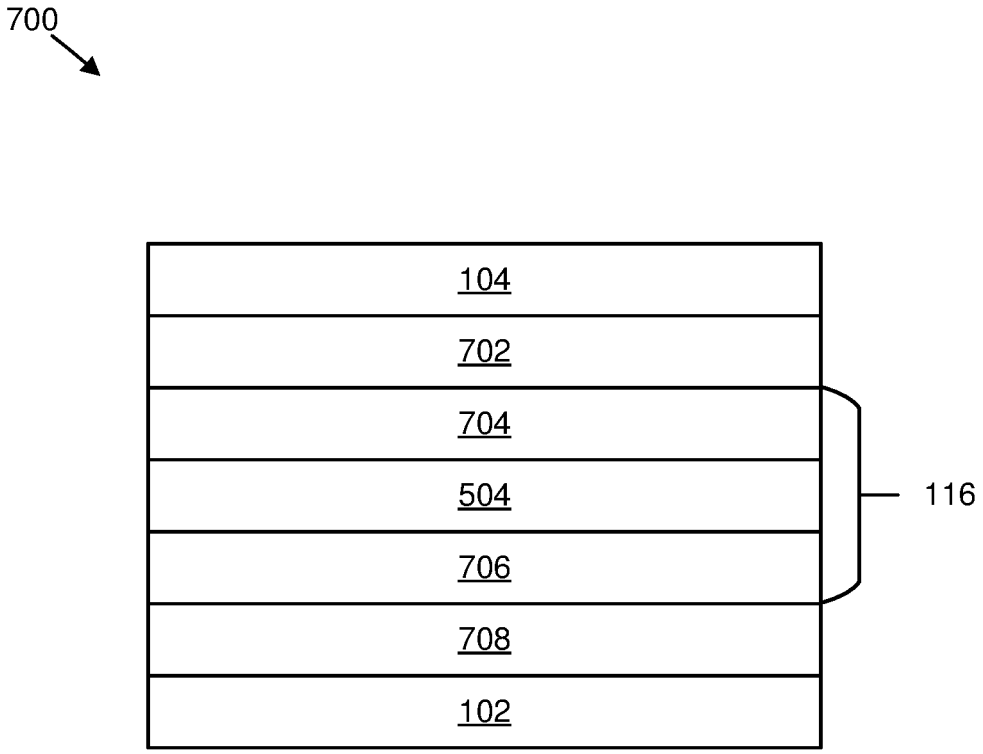
FIG. 7 is a schematic diagram illustrating another embodiment of layers of a pillow.

FIG. 7 is a schematic diagram illustrating another embodiment of layers 700 of the pillow 101. The layers 700 include the top surface 104, a top pocket layer 702, a top weighted bag layer 704, the weighted pellets 504, a bottom weighted bag layer 706, a bottom pocket layer 708, and the bottom surface 102. The top pocket layer 702 and the bottom pocket layer 708 are formed from the material 402. Moreover, the top weighted bag layer 704 and the bottom weighted bag layer 706 are formed from the material 502.

The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system comprising:

a pillow comprising:

a bottom surface comprising a first material;

a top surface coupled to the bottom surface, the top surface comprising:

a second material; and a third material, wherein the first material, the second material, and the third material have different tactile textures from one another, and the first material, the second material, and the third material are all on an exterior surface of the pillow;

a zipper coupling a first portion of the bottom surface to a second portion of the top surface;

a pocket formed between the top surface and the bottom surface, wherein the pocket is accessible using the zipper, and the pocket is configured to hold a plurality of weighted bags; and a handle comprising at least one tactile bead movable along the handle; and the plurality of weighted bags, wherein each weighted bag of the plurality of weighted bags comprises weighted pellets, and each weighted bag of the plurality of weighted bags is configured to be disposed in the pocket to adjust the weight within the pocket.

2. The system of claim 1, wherein the pillow further comprises interfacing.

3. The system of claim 2, wherein the interfacing comprises a fourth material coupled to at least one of the first material, the second material, and the third material, the fourth material is on an interior of the pillow, and the fourth material provides reinforcement to the at least one of the first material, the second material, and the third material.

4. The system of claim 3, wherein the fourth material is coupled to the at least one of the first material, the second material, and the third material using an adhesive.

5. The system of claim 4, wherein the adhesive is heat activated.

6. The system of claim 1, wherein a first external surface area of the first material is substantially equal to a sum of a second external surface area of the second material and a third external surface area of the third material.

7. The system of claim 1, wherein the second material comprises sequins.

8. The system of claim 1, wherein each weighted bag of the plurality of weighted bags is approximately the same weight.

9. The system of claim 1, wherein each weighted bag of the plurality of weighted bags has a substantially different weight.

10. An apparatus comprising:

a pillow comprising:

a bottom surface comprising a first material;

a top surface coupled to the bottom surface, the top surface comprising:

a second material; and a third material, wherein the first material, the second material, and the third material have different tactile textures from one another, and the first material, the second material, and the third material are all on an exterior surface of the pillow;

a zipper coupling a first portion of the bottom surface to a second portion of the top surface;

a pocket formed between the top surface and the bottom surface, wherein the pocket is accessible using the zipper, and the pocket is configured to hold a plurality of weighted bags; and a handle comprising at least one tactile bead movable along the handle.

11. The apparatus of claim 10, wherein the pillow further comprises interfacing.

12. The apparatus of claim 11, wherein the interfacing comprises a fourth material coupled to at least one of the first material, the second material, and the third material, the fourth material is on an interior of the pillow, and the fourth material provides reinforcement to the at least one of the first material, the second material, and the third material.

13. The apparatus of claim 12, wherein the fourth material is coupled to the at least one of the first material, the second material, and the third material using an adhesive.

14. The apparatus of claim 13, wherein the adhesive is heat activated.

15. The apparatus of claim 10, wherein a first external surface area of the first material is substantially equal to a sum of a second external surface area of the second material and a third external surface area of the third material.

16. The apparatus of claim 10, wherein the second material comprises sequins.

* * * * *